US007018765B2

(12) United States Patent
Uchida et al.

(10) Patent No.: US 7,018,765 B2
(45) Date of Patent: Mar. 28, 2006

(54) TONER PARTICLE HAVING A HARDNES OF 6.0 TO 24.0 MN AND A CIRCULARITY OF 0.92 TO 0.99

(75) Inventors: Tsuyoshi Uchida, Hino (JP); Masafumi Uchida, Hachioji (JP); Michiaki Ishikawa, Sagamihara (JP); Takao Yamanouchi, Sagamihara (JP); Ryuji Kitani, Hino (JP); Yasuko Yamauchi, Hachioji (JP)

(73) Assignee: Konica Corporation, (JP)

( * ) Notice: Subject to any disclaimer, the term of this patent is extended or adjusted under 35 U.S.C. 154(b) by 140 days.

(21) Appl. No.: 10/426,707

(22) Filed: Apr. 29, 2003

(65) Prior Publication Data

US 2003/0215732 A1 Nov. 20, 2003

(30) Foreign Application Priority Data

May 13, 2002 (JP) ..... 2002-137420

(51) Int. Cl.
*G03G 9/08* (2006.01)

(52) U.S. Cl. ..... 430/110.3; 430/110.1; 430/109.3; 430/124

(58) Field of Classification Search ..... 430/110.1, 430/110.3, 111.4, 124
See application file for complete search history.

(56) References Cited

U.S. PATENT DOCUMENTS

| | | | | |
|---|---|---|---|---|
| 2,297,691 | A * | 10/1942 | Carlson | 430/55 |
| 5,914,380 | A * | 6/1999 | Ito et al. | 526/318.6 |
| 6,610,453 | B1 * | 8/2003 | Akai et al. | 430/108.3 |
| 2003/0027072 | A1 * | 2/2003 | Horiuchi et al. | 430/110.1 |

* cited by examiner

*Primary Examiner*—Christopher Rodee
(74) *Attorney, Agent, or Firm*—Squire, Sanders & Dempsey L.L.P.

(57) ABSTRACT

An electrostatic photographic image forming toner is disclosed. The toner comprises a toner particle containing a binder resin and a colorant in which the binder resin has a specific softening point of from 105 to 132° C. and the toner particle has a hardness of from 6.0 to 24.0 mN and a circularity of from 0.92 to 0.99.

18 Claims, 2 Drawing Sheets

TONER PARTICLE HAVING A HARDNES OF 6.0 TO 24.0 MN AND A CIRCULARITY OF 0.92 TO 0.99

FIELD OF THE INVENTION

The invention relates to a toner and an image forming method.

BACKGROUND OF THE INVENTION

A single-component developer has usually been used for forming a color image in an electrophotographic method. As the image forming method using a single-component developer, a procedure is known in which a latent image formed on an electrostatic latent image carrying member is developed by the single-component developer composing a toner which is conveyed and supplied by a developer carrying member, and then thus obtained toner image is transferred onto an image receiving material, and the toner constituting the transferred toner image is fixed by heating.

In such a method, the necessary amount of static charge is given to the toner by triboelectricity since the toner is adhered to the developer carrying member by static charge and is conveyed. As a result, a problem resulted such that the toner is molten by the frictional effect and adhered as contamination to the constituents of the image forming apparatus, such as the developer carrying member.

Accordingly, a high quality image cannot be obtained since problems such as formation of unevenness of the image occurs even when a sufficiently high fixing performance of the toner is displayed.

In addition, when the toner contains an external additive, high transferring performance and developing performance are obtained with difficulty since such developer accompanies various problems caused by releasing of the external additive from the toner particle, or burying of the external additive into the toner particle.

SUMMARY OF THE INVENTION

This invention has been carried out on the foregoing background. An object of the invention is to provide a toner having high fixing performance and anti-contamination performance.

Another objective of the invention is to provide a toner which contains an external additive and has high fixing performance and anti-contamination performance together with excellent transferring performance and developing performance.

Another objective of the invention is to provide an image forming method by which a high quality image can be stably obtained.

The toner according to the invention is a toner comprising a toner particle containing a binder resin and a colorant in which the toner has a specific softening point of from 105 to 132° C. and the toner particle has a hardness of from 6.0 to 24.0 mN and a circularity of from 0.92 to 0.99.

The toner according to the invention preferably contains an external additive composed of inorganic particles having an average primary particle diameter of from 30 to 500 nm.

In the toner according to the invention, the toner particle contains a binder resin and a colorant and has a matrix-domain structure which is constituted by a continuous phase of the binder resin and an isolated phase of the colorant. The matrix-domain structure is comparable to the sea (matrix) and islands (domain) surrounded by the sea. The average area of Voronoi's polygon indicating respective domain portion (island phase) is preferably from 20,000 to 120,000 $nm^2$.

In the toner according to the invention, the variation coefficient of the circularity is preferably from 2.1 to 4.7%.

The binder resin comprises composite resin particles containing a core, an inter layer and an outer layer. The toner particle comprises preferably the composite resin particles and colorant particles.

The resin composing the core has preferably a smaller molecular weight than a resin composing the inter layer.

It is preferred that the inter layer contains a releasing agent and the core and the outer layer do not contain a releasing agent.

The toner according to the invention is suitably used in an image forming method by which a static latent image formed on a static latent image carrying member is developed by a single-component developer, and thus formed toner image is transferred onto an image receiving material and fixed by heat.

The toner according to the invention shows high fixing performance since the toner is sufficiently molten in the process for fixing the toner image by heating. Besides, adhesion of the molten toner as the contamination onto the constituting members of the image forming apparatus can be inhibited in the processes other than the fixing process, particularly in the process giving the necessary amount of electrical charge to the toner. Thus excellent fixing performance and the anti-contamination performance can be obtained.

When the toner according to the invention contains an external additive, the toner particle has specified particle hardness. Accordingly, releasing of the inorganic particle constituting the external additive can be inhibited and burying of the external additive into the toner particle can also be inhibited. Thus stable charging can be obtained without occurrence of damage on the members constituting the image forming apparatus caused by the external additive. Consequently, excellent fixing performance and anti-contamination performance together with the excellent transferring performance and developing performance can be obtained.

DETAILED DESCRIPTION OF THE INVENTION

Figure 1:
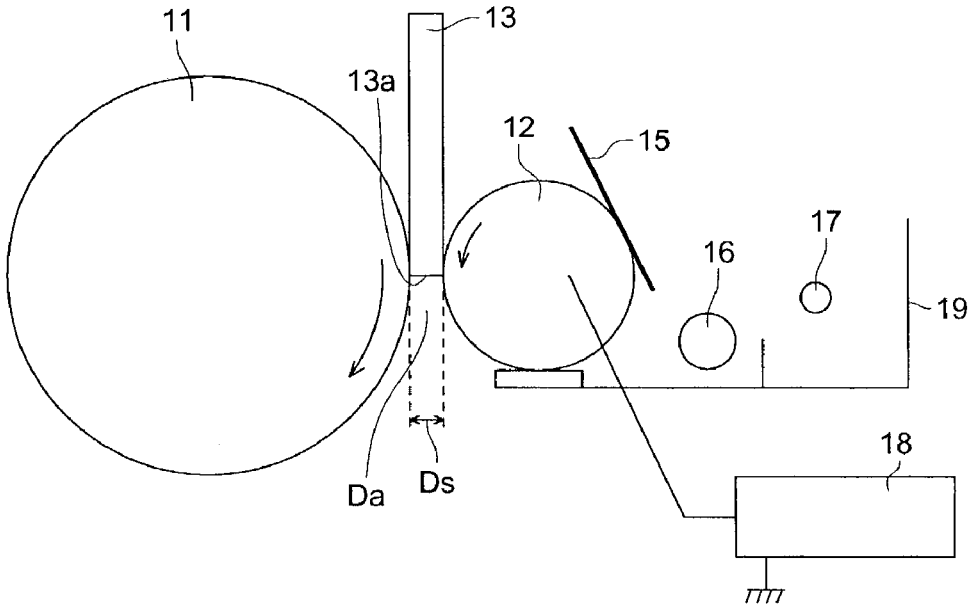
FIG. 1 shows a cross section of an example of the constitution of the developing device used in the invention.

The toner of the invention contains the binder resin and the colorant and comprises the toner particle which has a particle hardness of from 6.0 to 24.0 mN and a circularity of from 0.92 to 0.99, and the resin has a specific softening point of from 105 to 132° C., hereinafter also referred to simply as the specific softening point. The toner may contain the external additive.

The particle hardness is a value measured by a micro compressing test machine. In concrete, the compressing load necessary to deform the individual toner particle by 10%, hereinafter also referred to as 10% deformation compressing load, is measured under a condition of a temperature of from 15 to 32° C. and a relative humidity of from 40 to 55%. The measurement is carried out on 50 particles and the arithmetic average of the 50 measurements is calculated.

When the particle hardness is not less than 6.0 mN, excellent fixing performance and anti-contamination performance is obtained since the external additive is not buried into the colored particle, and charging of the toner becomes stable. On the other hand, when the particle hardness is not more than 24.0 mN, sufficient transferring performance is obtained and the good fixing performance is kept since the particle is difficultly deformed. In cases of the toner containing the external additive, the external additive is maintained along with the colored particle in the course of image forming process. Consequently, charging of the toner is kept stable and the long life of the image forming apparatus is attained since the member constituting the image forming apparatus such as the developer carrying member is kept clean.

The particle hardness is preferably from 8.0 to 22.0 mN, more preferably from 13.0 to 20.0 mN.

The circularity is a value calculated by the following formula from the area and the peripheral length of the plane projection image of toner particles measured by an image analysis apparatus. The circularity is 1 when the plane projection image is true circle.

The circularity can be measured by a flow type particle image analysis apparatus FPIA-2000, manufactured by Hosokawa Micron Co., Ltd.

$$\text{Circularity}=\{2\pi/(\text{area}/\pi)^{1/2}\}/(\text{peripheral length})$$

When toner particles have suitable circularity, excessive stress is not concentrated at any deformed portion of the toner particle. Therefore, the toner can be used with fewer problems in developing methods in which high stress is applied to the toner particle when the foregoing effect is combined with the effect of the toner particle having suitable hardness. Moreover, in cases of the toner containing an external additive, high transferring performance can be attained since the concentration of the external additive fixed onto the toner particle is uniformly held and deformation of the particle occurs with difficulty.

According to the technological means described above, the circularity is preferably from 0.94 to 0.98, more preferably from 0.96 to 0.98.

In the toner of the invention, the variation coefficient of the circularity is preferably from 2.1 to 4.7%, more preferably from 2.5 to 3.6%, and particularly preferably from 2.7 to 3.4%.

The flowing ability, the electrical charging ability and the cleaning suitability are not reduced by making the circularity of the particles uniform.

The variation coefficient is a value represented by the following equation.

$$\text{Variation coefficient}=\text{Standard deviation of circularity}/\text{Average value of circularity}\times 100(\%)$$

The specific softening point is a value measured by a flow tester. Concretely, measurement is carried out by using the flow tester with a die diameter of 1 mm under a condition of a temperature of 20° C. and a relative humidity of 50%. The previously prepared pellet of the binder resin, with a diameter of 10 mm and the length of 12 mm, is heated at 80° C. for 300 seconds. The specific softening point is determined from the relationship of the temperature and the flowing amount measured with a loading of 200 N at a temperature raising rate of 6° C. per minute. The specific softening point is determined by the temperature at which the flowing amount becomes 5 mm by the off-set method.

When the specific softening point is less than 105° C., glossiness of the image is excessive so that printed characters are read with difficulty, in addition, contamination of the developer carrying member tends to occur due to insufficient hardness of the particle. When the specific softening point exceeds 132° C., transparency of the obtained image is insufficient by which quality of the image is lowered. Particularly, transparency of the image is insufficient for OHP and color reproduction capability becomes insufficient and the fixing strength is also lowered.

From the viewpoint of the balance of the image quality and the fixing performance, the specific softening point of the toner is preferable from 108 to 124° C., more preferably from 112 to 120° C.

In the toner particle according to the invention, the average area of Volonoi's polygon is 20,000 to 120,000 $nm^2$, preferably from 40,000 to 100,000.

When the toner particles have the foregoing average area of Volonoi's polygon, the colorant is suitably dispersed in the particle and the colorant does not hinder the melting property of the binder resin. Consequently, the hardness of the toner particle can be controlled to a suitable value without any adverse influence on the fixing performance. Moreover, high transferring performance can be attained since irregularity of the electric resistivity caused by excessive coagulation of the colorant does not occur in the toner particles. When the toner particles have a suitable Volonoi's polygon area, probability of occurrence of insufficient charging and lowering of the particle hardness is reduced, and probability of contamination of the developer carrying member and lowering of the image density caused by excessive charge is also lowered.

In the invention, "the average area of Voronoi's polygon" is a value calculated based on the fact that the toner particle has a matrix-domain structure in the binder resin component, and the colorant components are each form isolated phases from each other without mixing so that the island-like isolated phase of the colorant component is dispersed in a continuous phase of the binder resin. Such value represents an occupation ratio of the island phase in the toner particle. Concretely the value is determined based on an electronmicroscopic photograph of the cross section of the toner particle using an image analysis apparatus attached to an electronmicroscope. The average value of the area of plural polygons, each formed by lines each perpendicularly crossing at the middle point of the line connecting the gravity centers of the adjacent islands, is determined for each of the toner particles. The determination is carried out for 1,000 particles and the arithmetic average of the thus obtained results is calculated.

Generally, in the system of a plane on which many points are dispersed, a polygon formed by partition of the plane by lines each perpendicularly crossing at the middle point of the line connecting the adjacent points is known as Voronoi's polygon, and such partition of the plane is called Voronoi's partition.

In toner particles having a large average value of Voronoi's polygon area, the distance between the gravity centers of the adjacent islands is large and the distribution of the islands in the toner particle is thin. In toner particles having a small average value of Voronoi's polygon area, the distance between the gravity centers of the adjacent islands is short and the distribution of the islands in the toner particle is dense.

The gravity center of islands can be obtained by the following procedure; the moment of the image, namely, the value coordinates and the luminance at the point of the coordinates are determined, and the sum of the product of all coordinates by the luminance values, each corresponding to coordinate value, is divided by the sum of the all the luminance values. The calculation can be automatically performed by an image analysis apparatus attached to a transmission electronmicroscope.

(Molecular Weight Distribution of the Resin Particle and Toner)

Resins used in the toner has preferably a molecular weight of from 500,000 to 1,000,000, and more preferably, has a peak or a shoulder within the ranges of from 40,000 to 500,000 and from 11,000 to 22,000 in the molecular weight distribution. An improvement of anti-offset effect and fixing characteristics are both satisfied by the resin having two peak or shoulder in the molecular weight distribution.

The ratio of weight average molecular weight to number average molecular weight (Mw/Mn), an index of molecular weight distribution, is preferably from 1.1 to 4.6, more preferably from 2.2 to 3.6.

Molecular weight of the resin composing toner is preferably measured by gel permeation chromatography (GPC) employing tetrahydrofuran (THF)

Added to 1 cc of THF is a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.48 to 0.50 μm, the filtrate is injected in a GPC.

Measurement conditions of GPC are described below. A column is stabilized at 40° C., and THF is flowed at a rate of 1 cc per minute. Then measurement is carried out by injecting approximately 100 μl of said sample at a concentration of 1 mg/cc. It is preferable that commercially available polystyrene gel columns are combined and used. For example, it is possible to cite combinations of Shodex GPC KF-801, 802, 803, 804, 805, 806, and 807, produced by Showa Denko Co., combinations of TSKgel G1000H, G2000H, G3000H, G4000H, G5000H, G6000H, G7000H, TSK guard column, and the like. Further, as a detector, a refractive index detector (IR detector) or a UV detector is preferably employed. When the molecular weight of samples is measured, the molecular weight distribution of said sample is calculated employing a calibration curve which is prepared employing monodispersed polystyrene as standard particles. Approximately ten polystyrenes samples are preferably employed for determining said calibration curve.

The specific softening point can be control by molecular weight as well as molecular weigh distribution, combination of plural polymer having different molecular weight and so on. Molecular weight distribution can be controlled by selecting species, amount, timing of addition etc. of a polymerization initiator.

Hardness of the toner particles can be controlled by selecting hardness of resin as well as composition of resin with colorant or other component.

The toner of the invention can be obtained by subjecting, for example, resin particles and colorant particles to a salting-out/coagulation process.

The resin particles to be coagulated can be obtained by polymerizing monomers in a water-based medium in such a way as emulsion polymerization.

Each of the resin particles is preferably a composite resin particle composed of plurality of resins having different monomer composition, molecular weight, molecular weight distribution, cross-linking degree and so on.

Characteristics such as a circularity or hardness of the toner particles can also be controlled by a condition of coagulation or digestion process such as time and temperature.

An example of the preparation of the resin particles is a multi-step polymerization such as three-step polymerization.

The objective toner having the specific properties can be suitably obtained by performing the control of the following methods in the production process of the toner.

When the resin particle is prepared by the three-step polymerization method, the molecular weight of the resin constituting the central portion is controlled so that the molecular weight is smaller than that of the resin constituting interlayer.

The dispersing status of the colorant in the aqueous medium is controlled in the salting out/fusion-adhering process by standing for certain period the aqueous medium in which the colorant is finely dispersed by the dispersing treatment.

When the resin particle is prepared in the polymerization process by the three-step polymerization method, the period for spherizing treatment by stirring of the associated particle after the association treatment by the salting out/fusion-adhering is controlled additionally the controlling of the molecular weight of the resin constituting the outer layer.

Radically polymerizable monomer is used for the polymerization, and in addition, cross-linking agent is used as necessity. It is preferred to use one of radically polymerizable monomer having acid group or basic group described below.

(1) Radical Polymerizable Monomer

The radical polymerizable monomer can be used, one or more kinds of which may be used for satisfying required properties.

Specifically, employed may be aromatic vinyl monomers, acrylic acid ester based monomers, methacrylic acid ester based monomers, vinyl ester based monomers, vinyl ether based monomers, monoolefin based monomers, diolefin based monomers, halogenated olefin monomers, and the like.

Listed as aromatic vinyl monomers, for example, are styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrne, 3,4-dichlorostyrene, and the like.

Listed as acrylic acid ester bases monomers and methacrylic acid ester monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, diethyl aminoethyl methacrylate, and the like.

Listed as vinyl ester based monomers are vinyl acetate, vinyl propionate, vinyl benzoate, and the like.

Listed as vinyl ether based monomers are vinyl methyl ether, vinyl ethyl ether, vinyl isobutyl ether, vinyl phenyl ether, and the like.

Listed as monoolefin based monomers are ethylene, propylene, isobutylene, 1-butene, 1-pentene, 4-methyl-1-pentene, and the like.

Listed as diolefin based monomers are butadiene, isoprene, chloroprene, and the like.

Listed as halogenated olefin based monomers are vinyl chloride, vinylidene chloride, vinyl bromide, and the like.

(2) Crosslinking Agents

In order to improve the desired properties of toner, added as crosslinking agents may be radical polymerizable crosslinking agents. Listed as radical polymerizable agents are those having at least two unsaturated bonds such as divinylbenzene, divinylnaphthalene, divinyl ether, diethylene glycol methacrylate, ethylene glycol dimethacrylate, polyethylene glycol dimethacrylate, phthalic acid diallyl, and the like.

(3) Radical Polymerizable Monomer Having Acid Group or Base Group

Examples of the radical polymerizable monomer having acid group or base group are carboxyl group containing monomer, sulfonic acid containing monomer, and amine compound such as primary amine, secondary amine, tertiary amine, and quaternary amine.

Examples of the carboxyl group containing monomer are acrylic acid, methacrylic acid, fumaric acid, maleic acid, itaconic acid, cinnamic acid, maleic monobutylate, and maleic monooctylate.

Examples of the sulfonic acid group containing monomer are styrenesulfonic acid, allylsulfosuccinic acid, and octyl allylsulfosuccinate.

These may be in the form of alkali metal salt such as sodium and potassium, or alkali earth metal salt such as calcium.

Examples of the radical polymerization monomer containing base is listed as amine compounds, specifically, dimethylaminoethylacrylate, dimethylaminoethylmethacrylate, diethylaminoethylacrylate, diethylaminoethylmethacrylate, and quaternary ammonium slat of the above four compounds, 3-dimethylaminophenylacrylate, 2-hydroxy-3-methacryloxy propyl trimethylammonium salt, acrylamide, N-butylacrylamide, N,N-dibutyl acrylamide, piperidyl acrylamide, methacrylamide, N-butylmethacrylamide, N-octadecyl acrylamide; vinyl N-methylpyridinium chloride, vinyl N-ethyl pyridinium chloride, N,N-diallyl methylammonium chloride and N,N-diallyl ethylammonium chloride.

As for the amount of the radical polymerization monomer, radical polymerizable monomer containing acid group or base group is 0.1 to 15 weight % with reference to the total amount of the monomers. The amount of the radical polymerization crosslinking agent, which varies depending on its property, is 0.1 to 10 weight % with reference to the whole radical polymerizable monomers.

Chain Transfer Agents

Aiming at the adjustment of molecular weight, generally used chain transfer agents may be employed.

Examples of the chain transfer agents include mercaptans such as octylmercaptan, dodecylmercaptan, tert-dodecylmercaptan, n-octyl-3-mercapto propionic acid ester, carbon tetrabromide, a-methylstyrene dimer, etc.

Polymerization Initiators

Water-soluble radical polymerization initiators may be optionally employed in the present invention. For example, are listed persulfate salts (potassium persulfate, ammonium persulfate, etc.), azo series compounds (4,4'-azobis-4-cyano valeric acid and its salt, 2,2'-azobis(2-amodinopropane) salt, etc. peroxide compounds.

Furthermore, the above-mentioned radical polymerization initiator may be employed in combination with a reducing agent if desired, and may be employed as a redox system initiator. The use of the redox system initiator enables the increase in polymerization activity and the decrease in polymerization temperature. As a result, the reduction in polymerization time may be expected.

The polymerization temperature is not limited if the temperature is higher than the lowest temperature at which the polymerization initiator induces the formation of a radical. The temperature of 50 to 90° C. is employed. However, the use of the polymerization initiator such as, for example, a combination of hydrogen peroxide-reducing agent (ascorbic acid, etc.) which enables initiation at room temperature makes it possible to conduct the polymerization at room temperature or lower.

Surface Active Agents

Surface active agent is employed in polymerization using the radical polymerizable monomer.

Surface active agents include sulfonic acid salts such as sodium dodecylbenzenesulfonate, sodium arylalkylpolyethersulfonate, sodium 3,3-disulfondiphenylurea-4,4-diazo-bis-amino-8-naphthol-6-sulfonate, ortho-carboxybenzene-azo-dimethylaniline, sodium 2,2,5,5-tetramethyl-triphenylmethane-4,4-diazo-bis-β-naphthol-6-sulfonate, etc., sulfonic ester salts such as sodium tetradecylsulfate, sodium pentadecylsulfate, sodium octylsulfate, etc., fatty acid salts such as sodium oleate, sodium laurate, sodium caprate, sodium caprylate, sodium caproate, potassium stearate, calcium oleate, etc.

In the present invention, surface active agents represented by Formulas (1) and (2) are most preferably employed.

$$R^1(OR^2)_pOSO_3M \qquad \text{Formula (1)}$$

In Formula (1), $R^1$ represents an alkyl or arylalkyl group having from 6 to 22 carbon atoms. $R^2$ represents an alkylene group having from 2 to 6 carbon atoms. $M^1$ is a mono-valent metal element. p is an integer of 1 to 11.

$$R^3(OR^4)_qSO_3M \qquad \text{Formula (2)}$$

In Formula (1), $R^3$ represents an alkyl or arylalkyl group having from 6 to 22 carbon atoms. $R^4$ represents an alkylene group having from 2 to 6 carbon atoms. $M^2$ is a mono-valent metal element. q is an integer of 1 to 11.

In the above Formulas each of $R^1$ and $R^3$ is preferably an alkyl or arylalkyl group having from 8 to 20 carbon atoms and is more preferably an alkyl or arylalkyl group having from 9 to 16 carbon atoms.

Listed as alkyl group having from 6 to 22 carbon atoms represented by $R^1$ or $R^2$ are, for example, an n-hexyl group, an n-heptyl group, an n-octyl group, an n-decyl group, an n-undecyl group, a hexadecyl group, a cyclopropyl group, a cyclopentyl group, and a cyclohexyl group. Listed as arylalkyl groups represented by $R^1$ or $R^3$ are a benzyl group, a diphenylmethyl group, a cinnamyl group, a styryl group, a trityl group, and a phenethyl group.

In Formulas (1) and (2), each of $R^2$ and $R^4$ is an alkylene groups having from 2 to 6 carbon atoms, and preferably an alkylene group having 2 or 3 carbon atoms. Listed as alkylene groups represented $R^2$ or $R^4$ are an ethylene group, a trimethylene group, a tetramethylene group, a propylene group, and an ethylethylene group.

In Formulas (1) and (2), each of p and q represents an integer of 1 to 11; and is preferably from 2 to 10, is more preferably from 2 to 5, and is most preferably 2 or 3.

In Formulas (1) and (2), listed as monovalent metal elements represented by $M^1$ and $M^2$ are sodium, potassium, and lithium. Of these, sodium is preferably employed.

Specific examples of surface active agents represented by Formulas (1) and (2) are illustrated below:

(a): $C_{10}H_{21}(OCH_2CH_2)_2OSO_3Na$ (b): $C_{10}H_{21}(OCH_2CH_2)_3OSO_3Na$ (c): $C_{10}H_{21}(OCH_2CH_2)_2SO_3Na$ (d): $C_{10}H_{21}(OCH_2CH_2)_3SO_3Na$ (e): $C_8H_{17}(OCH_2CH(CH_3))_2OSO_3Na$ (f): $C_{18}H_{37}(OCH_2CH_2)_2OSO_3Na$

The content of the surface active agents represented by the aforesaid Formulas (1) and (2) in the toner is preferably from 1 to 5,000 ppm, is more preferably from 5 to 1,000 ppm, and is most preferably from 7 to 500 ppm.

The static charge of the electrostatic image developing toner of the present invention is built up being independent of ambience, and can be uniformly and stably provided and maintained by adjusting the amount of the surface active agents incorporated to the amount.

Further, the content of the surface active agents represented by the aforesaid Formulas (1) and (2) is calculated employing the method described below.

One g of toner is dissolved in chloroform, and surface active agents are extracted from the chloroform layer employing 100 ml of deionized water. Further, said chloroform layer, which has been extracted, is further extracted employing 100 ml of deionized water, whereby 200 ml of extract (being a water layer) is obtained, which is diluted to 500 ml.

The resulting diluted solution is employed as a test solution which is subjected to coloration utilizing Methylene Blue based on the method specified in JIS 33636. Then, its absorbance is determined, and the content of the surface active agents in the toner is determined employing the independently prepared calibration curve.

Further, said extract is analyzed employing 1H-NMP, and the structure of the surface active agents represented by Formulas (1) and (2) is determined.

A nonion surfactant may be employed in the invention. Practically, examples thereof include polyethylene oxide, polypropylene oxide, combination of polyethylene oxide and polypropylene oxide, ester of polyethylene glycol and higher aliphatic acid, alkylphenol polyethylene oxide, ester of higher aliphatic acid and polyethylene glycol, ester of higher aliphatic acid and polypropylene oxide, and sorbitan ester.

The toner particles may optionally contain a compound having releasing function, which improves fixing ability.

Preferable examples of the releasing agent having releasing property include low molecular weight polypropylene having average molecular weight of 1,500 to 9,000 and low molecular weight polyethylene, and a particularly preferable example is an ester compounds represented by Formula (3), described below.

$$R^5—(OCO—R^6)_S \qquad \text{Formula (3)}$$

wherein s represents an integer of 1 to 4, and preferably 2 to 4, more preferably 3 or 4, and in particular preferably 4, $R^5$ and $R^6$ each represent a hydrocarbon group which may have a substituent respectively. $R^5$ has from 1 to 40 carbon atoms, and preferably 1 to 20, more preferably 2 to 5. $R^6$ has from 1 to 40 carbon atoms, and preferably 16 to 30, more preferably 18 to 26. $R^5$ and $R^6$ may be same or different from each other.

Practical compounds are exemplified.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{17}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6)

$$CH_3—(CH_2)_{20}—COO—(CH_2)_2—\overset{\overset{CH_3}{|}}{CH}—CH_2—O—CO—(CH_2)_{20}—CH_3$$

7)

$$CH_3—(CH_2)_{22}—COO—(CH_2)_2—\overset{\overset{CH_3}{|}}{CH}—CH_2—O—CO—(CH_2)_{22}—CH_3$$

8)

$$CH_3—(CH_2)_{22}—COO—CH_2—\underset{\underset{CH_3}{|}}{\overset{\overset{CH_3}{|}}{C}}—CH_2—O—CO—(CH_2)_{22}—CH_3$$

9)

$$CH_3—(CH_2)_{26}—COO—CH_2—\underset{\underset{CH_3}{|}}{\overset{\overset{CH_3}{|}}{C}}—CH_2—O—CO—(CH_2)_{26}—CH_3$$

10)

$$\begin{array}{l} CH_2—O—CO—(CH_2)_{26}—CH_3 \\ | \\ CH—O—CO—(CH_2)_{26}—CH_3 \\ | \\ CH_2—O—CO—(CH_2)_{26}—CH_3 \end{array}$$

11)

$$\begin{array}{l} CH_2—O—CO—(CH_2)_{22}—CH_3 \\ | \\ CH—O—CO—(CH_2)_{22}—CH_3 \\ | \\ CH_2—O—CO—(CH_2)_{22}—CH_3 \end{array}$$

12)

$$\begin{array}{l} CH_2—OH \\ | \\ CH—O—CO—(CH_2)_{26}—CH_3 \\ | \\ CH_2—O—CO—(CH_2)_{26}—CH_3 \end{array}$$

13)

$$\begin{array}{l} CH_2—OH \\ | \\ CH—O—CO—(CH_2)_{22}—CH_3 \\ | \\ CH_2—O—CO—(CH_2)_{22}—CH_3 \end{array}$$

14)

$$\begin{array}{l} CH_2—OH \\ | \\ CH—OH \\ | \\ CH_2—O—CO—(CH_2)_{26}—CH_3 \end{array}$$

15)

$$\begin{array}{l} CH_2—OH \\ | \\ CH—OH \\ | \\ CH_2—O—CO—(CH_2)_{22}—CH_3 \end{array}$$

-continued

16)

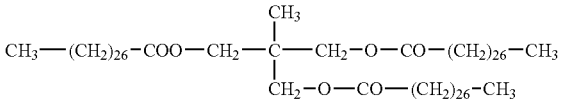

17)

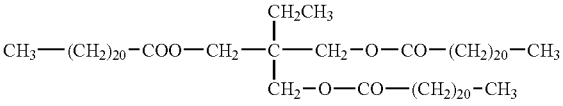

18)

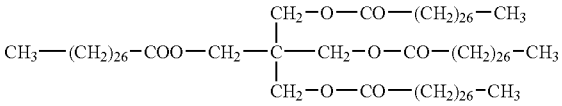

19)

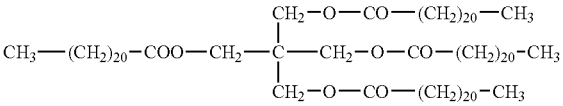

20)

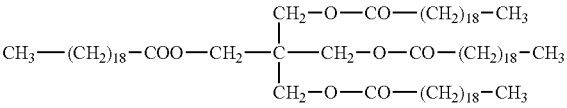

21)

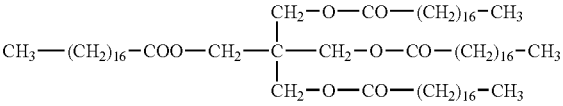

22)

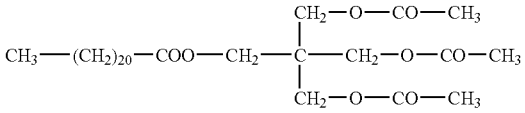

As a containing ratio of the compound in the toner, it is preferable that crystalline polyester is from 1 to 30 percent by weight, and more preferably from 2 to 20 percent by weight, and in particular from 3 to 15 percent by weight of toner weight as a whole.

The releasing agent can be incorporated in the resin particle by such a way in which the releasing agent is dissolved in polymerizable monomer liquid and then the monomer liquid is subjected to polymerization.

Methods are preferred in which dispersion is carried out employing mechanical force. Said monomer solution is preferably subjected to oil droplet dispersion (essentially an embodiment in a mini-emulsion method), employing mechanical force, especially into water based medium prepared by dissolving a surface active agent at a concentration of lower than its critical micelle concentration. An oil soluble polymerization initiator may be added to the monomer solution in place of a part or all of water soluble polymerization initiator.

Herein, homogenizers to conduct oil droplet dispersion, employing mechanical forces, are not particularly limited, and include, for example, "CLEARMIX", ultrasonic homogenizers, mechanical homogenizers, and Manton-Gaulin homogenizers and pressure type homogenizers. The diameter of dispersed particles is 10 to 1,000 nm, and is preferably 30 to 300 nm.

Colorant particles can be prepared by dispersing the colorant in a water based medium. The dispersion process is undergone in the presence of a surface active agent at a concentration higher than or equal to the critical micelle concentration (CMC).

Listed as dispersion devices employed for the dispersion process of said coloring agent particles may be, in addition to CLEARMIX, pressure homogenizers such as ultrasonic homogenizers, mechanical homogenizers, Manton-Gaulin homogenizer, and pressure type homogenizers, and medium type homogenizers such as Getzman dispersers and fine diamond mills.

As coloring agents which can be employed in the toner of the present invention, any conventionally known coloring agents may optionally be used, and this includes, for example, carbon black, magnetic materials, dyes and pigments. As carbon black, for example, channel black, furnace black, acetylene black, thermal black, lamp black, etc. can be mentioned. As magnetic materials, for example, ferromagnetic metals such as iron, nickel, cobalt, etc.; alloys containing these metals; compounds of the ferromagnetic metals such as ferrite, magnetite, etc.; alloys, which do not contain ferromagnetic metals, but show ferromagnetic nature upon heat treatment, such as so-called Heusler's alloy like manganese-copper-aluminum alloy, manganese-copper-tin alloy, chromium dioxide, etc. can be used.

Dye example are C.I. Solvent Red Nos.1, 49, 52, 58, 63, 111 and 122; C.I. Solvent Yellow Nos. 19, 44, 77, 79, 81, 82, 93, 98, 103, 104, 112 and 162; C.I. Solvent Blue Nos. 25, 36, 60, 70, 93 and 95, etc., and these dyes may be used in combination. As pigments, for example, C.I. Pigment red Nos. 5, 48:1, 53:1, 57:1, 122, 139, 144, 149, 166, 177, 178, 222; C.I. Pigment orange Nos.31 and 43; C. I. Pigment yellow Nos.14, 17, 93, 94, 138; C.I. Pigment green No.7; and C.I. Pigment blue Nos.15:3, and 60, etc. can be used. These pigments may also be used in combination. These coloring agents, having primary particles having a number average primary particle diameter of about 10 to 200 nm, are preferably dispersed into the toner.

The colorants may also be employed while subjected to surface modification. As said surface modifying agents may be those conventionally known in the art, and specifically, preferably employed may be silane coupling agents, titanium coupling agents, aluminum coupling agents, and the like. Surface of the colorant may be modified in such way that the surface modifier is added to the dispersion of colorant, then the dispersion is heated to conduct reaction. Colorant having subjected to the surface modification is separated by filtration and dried after repeating rinsing and filtering with the same solvent.

An example of preparation method of the resin particles containing a releasing agent includes the following processes:

1. Dissolving process in which the releasing agent is dissolved in polymerizable monomer solution to prepare a monomer solution.

2. Dispersion process in which the monomer solution is dispersed in a water-based medium.

3. Polymerization process in which the obtained dispersion is subjected to polymerization to prepare a dispersion of resin particles (latex) containing the releasing agent.

4. Salting-out/fusing process in which the obtained resin particles and the colorant particles are subjected to salting-out/fusing in the water-based medium to obtain toner particles.

5. Filtering/washing process in which the obtained toner particles are separated from the water-based medium by filtration and toner particles are wash so as to remove a surfactant and so on.

6. Drying process in which the washed toner particles are dried.

The process may further includes,

7. Addition process of an external additive in which an external additive is added to the dried toner particles.

(1) Dissolving Process

A releasing agent is dissolved in monomer solution. The releasing agent is added so that amount of the releasing agent is 1 to 30 weight %, preferably 2 to 20 weight %, more preferably 3 to 15 weight % of the toner. An oil-soluble component such as oil-soluble polymerization initiator may be added in the monomer solution.

(2) Dispersion Process

Monomer solution is dispersed in water-based medium. Dispersion method employing mechanical energy is preferable. Particularly monomer solution is dispersed as oil droplets in water based medium containing surface active agent less than critical micelle concentration by employing mechanical energy. This is a necessary embodiment of the mini-emulsion method.

In this process a homogenizers to conduct oil droplet dispersion, employing mechanical forces, are not particularly limited, and include, for example, "CLEARMIX", ultrasonic homogenizers, mechanical homogenizers, and Manton-Gaulin homogenizers and pressure type homogenizers.

The diameter of dispersed particles is 10 to 1,000 nm, and is preferably 30 to 300 nm.

In the polymerization process, polymerization methods (granulation polymerization methods such as an emulsion polymerization method, a suspension polymerization method, and a seed polymerization method) may be employed.

Listed as one example of the preferred polymerization method may be a mini-emulsion method, namely in which radical polymerization is carried out by adding water-soluble polymerization initiators to a dispersion obtained by oil droplet dispersing a monomer solution, employing mechanical force, into a water based medium prepared by dissolving a surface active agent at a concentration lower than its critical micelle concentration.

Polymerization reaction is carried out while dividing into multiple steps so that in the resulting resin particle, the molecular weight gradient is formed from the center of the particle to its surface layer to form phases having different molecular weight distributions in one resin particle.

The composite resin particle is a multi-layer particle having a core resin and one or more resin layers covering the core. The resin of the covering layer has different molecular weight or different monomer composition. Multi-step polymerization comprises a plurality of polymerization in which another polymer having different molecular weight or monomer composition on the surface of the resin obtained previously is formed. For example, a method is employed in which after preparing dispersion comprised of high molecular weight resin particles, a low molecular weight surface layer is formed by newly adding polymerizable monomers as well as chain transfer agents.

Three-step polymerization is One of a preferable embodiment, by which a composite resin particle having a center portion (core) composed of high molecular weight polymer, an inter layer composed of middle molecular weight polymer and containing a releasing agent, and an outer layer (shell) composed of low molecular weight polymer.

The toner comprising composite resin particles obtained by the three-step polymerization exhibits preferable anti-offset and preferable fixing characteristics because the releasing agent is incorporated so that the releasing agent is not exposed to the surface of the particle whereby association force between the particles is strong and also higher hardness of particles is obtained. The releasing agent at the surface hiders the entangle reaction of molecular chain of the resin, whereby sufficient association strength is not obtained.

Toner particles having preferable hardness can be obtained by employing higher molecular weight polymer in the interlayer than that of core or outer layer.

The coagulation and fusing processes is performed in water-based medium, whose temperature does not usually exceed 100° C. at normal atmosphere. Particles comprising such low molecular weight outer layer as having Tg less than about 100° C. forms hard associated particle in the water based medium. When the molecular weight of the outer layer is so high as having more than Tg, the particles do not form a strong associated particle. These characteristics are important for a single-component developer.

This method will now be specifically described. Initially, a dispersion comprised of resin particles, which have been prepared by polymerization (the first step polymerization) according to a conventional method, is added to a water-based medium (for example, an aqueous surface active agent solution). After dispersing a monomer solution into the water-based medium so as to form oil droplets, the resulting system undergoes polymerization (the second step polymerization), whereby a covering layer (an interlayer) comprised of resins is formed on the surface of resin particles (nucleus particles). Thus dispersion of a composite resin particle (comprised of high molecular weight resins and intermediate molecular weight resins) is prepared.

Subsequently, polymerization initiators and monomers to prepare a low molecular weight resin are added to the resulting composite resin particle dispersion, and the monomers undergo polymerization (the third step polymerization) in the presence of the composite resin particles, whereby a covering layer comprised of a low molecular weight resin (a polymer of the monomers) is formed.

(4) Salting Out and Fusion Process

In the process of salting out, coagulation and fusion composite resin particles obtained by multi-step polymerization and colorant particles are subjected to salting out, coagulation and fusion wherein salting out and fusion are caused simultaneously.

An internal additive such as a charge controlling agent may be added further to the resin particles and the colorant particles.

Resin particles not containing the releasing agent may be also salted out, as well as the resin particles containing the releasing agent.

The term "water-based medium" is used to refer to a medium which is comprised of at least 50 percent of water by weight. Exemplified as water-soluble solvents may be, for example, methanol, ethanol, isopropanol, butanol, acetone, methyl ethyl ketone, and tetrahydrofuran. Of these, preferred are alcohol based organic solvents, which do not dissolve the prepared resins.

The colorant particles are prepared by dispersing the colorant in the water based medium. The water based medium to disperse the colored particles includes an aqueous solution dissolving a surfactant in concentration not less than critical micelle concentration (CMC).

Homogenizers employed in the dispersion of the colorant particles include, for example, "CLEARMIX", ultrasonic homogenizers, mechanical homogenizers, and Manton-Gaulin homogenizers, pressure type homogenizers and medium dispersion machines such as GETSMAN MILL and DIAMOND FINE MILL.

The toner particles can be modified to have specific hardness by controlling the dispersion state of the colorant particles dispersed in the water-based medium in such a way that the water-based medium dispersing the colorant particles are kept standing for predetermined time.

The colorants may also be employed while subjected to surface modification. Surface of the colorant may be modified in such way that the surface modifier is added to the dispersion of colorant, then the dispersion is heated to conduct reaction. Colorant having subjected to the surface modification is separated by filtration and dried after repeating rinsing and filtering with the same solvent.

Herein, listed as alkali metals of alkali metal salts, and as alkali earth metals of alkali earth metal salts employed as salting agents are lithium, potassium, sodium, and the like, and magnesium, calcium, strontium, barium, and the like, respectively. Preferably listed are potassium, sodium, magnesium, calcium, and barium. Further, listed as components to form the salts are chloride salts, bromide salts, iodide salts, carbonate salts, sulfate salts, and the like.

Further, listed as said organic solvents, which are infinitely soluble in water, are alcohols such as methanol, ethanol, 1-propanol, 2-propanol, ethylene glycol, glycerin, acetone, and the like. Of these, preferred are methanol, ethanol, 1-propanol, and 2-propanol which are alcohols having not more than three carbon atoms.

In the salting out/fusion-adhering process, it is preferable that hold-over time after the addition of salting-out agents is as short as possible. Namely it is preferable that after the addition of salting-out agents, dispersion comprised of resinous particles and colorant particles is heated as soon as possible and heated to a temperature higher than the glass transition point of said resinous particles. The reason for this is not well understood. However, problems occur in which the aggregation state of particles varies depending on the hold-over time after salting out so that the particle size distribution becomes unstable and surface properties of fused toner particles fluctuate.

Time before initiating heating (hold-over time) is commonly not more than 30 minutes, and is preferably not more than 10 minutes.

Temperatures, at which salting-out agents are added, are not particularly limited, and are preferably no higher than the glass transition temperature of resinous particles.

Further, it is required that in the salting out/fusion-adhering process, the temperature is quickly increased by heating. The rate of temperature increase is preferably no less than 1° C./minute. The maximum rate of temperature increase is not particularly limited. However, from the viewpoint of minimizing the formation of coarse grains due to rapid salting out/fusion-adhering, said rate is preferably not more than 15° C./minute.

Further, after the dispersion comprised of resinous particles and colorant particles is heated to a higher temperature than said glass transition point, it is important to continue the salting out/fusion-adhering by maintaining the temperature of said dispersion for a specified period of time. By so doing, it is possible to effectively proceed with the growth of toner particles (aggregation of resinous particles as well as colorant particles) and fusion (disappearance of the interface between particles. As a result, it is possible to enhance the durability of the finally obtained toner.

Further, after terminating the growth of coalesced particles, fusion by heating may be continued.

The toner particles can be modified to have specific hardness by controlling the molecular weight of the outer layer and controlling the agitation time for making the coagulated particles aspherical after the salting-out/fusion process in the three step polymerization method.

(5) Filtration and Washing Process

In the filtration and washing process, carried out is filtration in which toner particles are collected from the toner particle dispersion obtained by the process previously described, and adhered materials such as surface active agents, salting-out agents, and the like, are removed from the collected toner particles (a caked aggregation). Herein, the filtration methods are not particularly limited, and include a centrifugal separation method, a vacuum filtration method which is carried out employing Buchner's funnel and the like, a filtration method which is carried out employing a filter press, and the like.

Drying Process

In this process the washed toner particles are dried. Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably employed.

It is proposed that the moisture content of dried toners is preferably not more than 5 percent by weight, and is more preferably not more than 2 percent by weight.

Further, when dried toner particles are aggregated due to weak attractive forces among particles, aggregates may be subjected to pulverization treatment. Herein, employed as pulverization devices may be mechanical pulverization devices such as a jet mill, a Henschel mixer, a coffee mill, a food processor, and the like.

Addition Process of External Additives

This process is one in which external additives are added to dried toner particles.

Listed as devices which are employed for the addition of external additives, may be various types of mixing devices known in the art, such as tubular mixers, Henschel mixers, Nauter mixers, V-type mixers, and the like.

Besides colorants and releasing agents, materials, which provide various functions as toner materials may be incorporated into the toner of the present invention. Specifically, charge control agents are cited. Said agents may be added employing various methods such as one in which during the salting out/fusion-adhering stage, said charge control agents are simultaneously added to resinous particles as well as colorant particles so as to be incorporated into the toner, another is one in which said charge control agents are added to resinous particles, and the like.

In the same manner, it is possible to employ various charge control agents known in the art, which can be dispersed in water. Specifically listed are nigrosine based dyes, metal salts of naphthenic acid or higher fatty acids, alkoxyamines, quaternary ammonium salts, azo based metal complexes, salicylic acid metal salts or metal complexes thereof.

Furthermore, the toner of the present invention may be advantageously employed when combined with external additives of fine particles, such as fine inorganic particles and fine organic particles having an average primary particle diameter of 30 to 500 nm.

Toner having stable transfer characteristics and development characteristics is obtained by employing inorganic fine particles having an average primary particle diameter of 30 to 500 nm. The inorganic fine particles works as a spacer between the toner particles and developing devises such as latent image carrying member and developer carrying member, and thereby the electrostatic force is reduced.

Preferably employed as such fine inorganic particles are inorganic oxide particles such as silica, titania, alumina, and the like. These fine inorganic particles are preferably subjected to hydrophobic treatment employing silane coupling agents, titanium coupling agents, and the like. The degree of the hydrophobic treatment is not particularly limited, however the degree is preferably between 40 and 95 measured as methanol wettability. The methanol wettability as described herein means the evaluation of wettability for methanol.

In this method, 0.2 g of fine inorganic particles is weighed and added to 50 ml of distilled water placed in a 200 ml beaker. Methanol is slowly added dropwise while slowly stirring from a burette of which top is immersed in the solution until entire fine organic particles are wet. The degree of hydrophobicity is calculated from the formula given below:

$$\text{Degree of hydrophobicity } (\%) = a/(a+50) \times 100$$

wherein "a" (in ml) represents the amount of methanol required for making fine inorganic particles perfectly wet.

Further, employed as fine organic particles are fine spherical organic particles having a number average primary particle diameter of 10 to 2,000 nm. Employed as such particles may be homopolymers or copolymers of styrene or methyl methacrylate.

Listed as lubricants, for example, are metal salts of higher fatty acids, such as salts of stearic acid with zinc, aluminum, copper, magnesium, calcium, and the like; salts of oleic acid with zinc, manganese, iron, copper, magnesium, and the like; salts of palmitic acid with zinc, copper, magnesium, calcium, and the like; salts of linoleic acid with zinc, calcium, and the like; and salts of ricinolic acid with zinc, calcium, and the like.

The added amount of these external additives is preferably 0.1 to 5 percent by weight with respect to the toner. The external additives are added to dried toner particles. Two or more types additives may be incorporated in combination.

The toner according to the invention is constituted by a toner particle comprising a binder resin having a specified softening point and a specified circular degree and a specified hardness. Therefore, the toner displays high fixing ability since the toner is sufficiently fused in a fixing process for thermally fixing the toner image transferred onto an image receiving material. Moreover, in a process other than the fixing process, particularly in the process for giving necessary charge to the toner, the adhering of the fused toner as the stain on the members constituting the image forming apparatus can be inhibited. Accordingly, excellent fixing ability and ant-staining ability can be obtained.

When the toner contains an external additive, releasing of an inorganic particle of the external additive from the toner particle and the burying the external additive into the toner particle are prevented since the toner particle has the specific hardness. Consequently, any damage on the constituting member of the image forming apparatus caused by the external additive released from the toner particle is not occurred and stable charging can be obtained. Thus superior transferring ability and developing ability can be obtained together with the excellent fixing ability and the anti-staining ability.

There is no specific limitation on the means for obtaining the toner having the specific properties. The objective toner can be suitably obtained by performing the control of the following 1 to 3 in the production process of the toner.

1. When the resin particle is prepared by the three-step polymerization method, the molecular weight of the resin constituting the central portion is controlled so that the molecular weight is smaller than that of the resin constituting interlayer.

2. The dispersing status of the colorant in the aqueous medium is controlled in the salting out/fusion-adhering process by standing for certain period the dispersion in which the colorant is finely dispersed by the dispersing treatment.

3. Dispersion status of the salting-out/fusion-adhering process is controlled by pH variation according to the clorant.

4. When the resin particle is prepared in the polymerization process by the three-step polymerization method, the period for spherizing treatment by stirring of the associated particle after the association treatment by the salting out/fusion-adhering is controlled additionally the controlling of the molecular weight of the resin constituting the outer layer.

Developer

Several cases may be considered for application of the toner of the present invention, in which, for example, comprising magnetic materials, it is employed as a single component magnetic toner; mixed with a so-called carrier, it is employed as a two-component toner; or a non-magnetic toner is individually employed; and the like. This toner is particularly suitable for color image forming process as a non-magnetic one-component developer.

In case that the toner is employed as a non-magnetic one-component toner, a developer having a developer layer thickness regulating device, by which thin developer layer is formed, is employed in the contacting development method or non-contacting development method. Contacting development method is preferable.

Employed as carriers constituting the two-component developer material, may be materials which are conventionally known in the art, such as metals, e.g., iron, ferrite, magnetite, and the like, and alloys of said metals with metals such as aluminum, lead, and the like, as magnetic particles. Specifically, ferrite particles are preferred. The volume average particle diameter of said magnetic particles is preferably between 15 and 100 μm, and is more preferably between 25 and 60 μm. The volume average particle diameter of carrier may be measured employing a laser diffraction type particle size distribution measuring device, HELOS* (manufactured by SYMPATEC Co.) equipped with a wet-type homogenizer as a representative device.

Such the developer is suitably applied for the image forming method in which a static latent image formed on a static latent image carrying member is developed by a one-component developer, the visualized image is transferred onto a image receiving material and transferred toner image is fixed by heating.

Either a contact developing method or non-contact developing method can be applied without any limitation for the developing method to be applied for the developing process in which the latent image formed on the static latent image carrying member is developed by the developer to visualize the image and thus formed toner image is transferred onto the image receiving material.

The suitable fixing method to be applied for the fixing process in which the toner image formed on the image receiving material in the developing process is, for example, a method so called a contact heating method. In the contact heating method, the fixing is performed by passing the image receiving material carrying the toner image between a heating roller and a pressure roller. As the contact heating method, a heat-pressing fixing method, particular a heating roller method and a pressing contact-heating method by which the fixing is carried out by a rotating pressing member included fixed heating member are suitably applied.

FIG. 1 is a cross section showing an example of a constitution of a developing device to be used in the invention.

The developing device has a static latent image carrying member 11, a developer carrying member 12 composed of a developing sleeve which is arranged so as to face to the static latent image carrying member 11 in a hopper 19 containing the developer and a position deciding member 13 for adjusting the distance or gap Ds between the developer carrying member 12 and the static latent image carrying member 11 to the designated value.

In FIG. 1, 15 is a regulation member for regulating the thickness of the developer layer formed on the developer carrying member 12 such as a stainless steel SUS plate with a thickness of 0.1 mm; 16 and 17 are each a stirring and supplying member; and 18 is a developing bias power source for generating the alternative electric field.

The static latent image carrying member 11 is a photoconductive drum which has a surface layer constituted by a negatively chargeable organic photo receptor, and is clockwise rotated, in the direction of the arrow in FIG. 1, at a constant speed.

The developer carrying member is constituted by the cylindrical developing sleeve which has a diameter, for example, of 17 mm and is made from an electroconductive flexible material such as a polyamide resin with a thickness of 1 mm.

A driving roller, which is not shown in the drawing, having a diameter slightly smaller than the internal diameter of the developing sleeve is included in the developing sleeve. The developing sleeve is rotated anti-clockwise the same direction as that of the driving roller as shown by the arrow in the drawing, by the frictional force occurred between the outer circumference of the driving roller and the internal circumference of the developing sleeve by the rotation of the driving roller.

The position deciding member 13 is composed of, for example, polyester film with a thickness of 0.1 mm. The end of it 13*a*, the lower end in the drawing, is positioned so that the developing nip width is 1.5 mm or more in the developing zone Da. The position deciding member is inserted at the upper stream side of the rotating direction (the upper half side position in the drawing) between the developer carrying member 12 and the static latent image carrying member so as to be parallel with the length direction of the developing zone Da, and contacted by pressure with the developer carrying member 12 and the static latent image carrying member 11.

By the position deciding member 13, the gap distance Ds between the developer carrying member 12 and the static latent image carrying member is set at the designated value and the gap distance Ds is adjusted at the suitable value over the whole range of the image width.

The developing bias power source is constituted by a direct current power source outputting the designated developing bias voltage Vb, for example about 500 V, and a alternative current power source generating a alternative electric field with, for example, a Vpp of 2.0 kV and a frequency of 2 kHz. The Vpp is the peak to peak voltage which is difference between the maximum and the minimum values of the alternative voltage wave.

In such the developing apparatus, the static latent image carrying member 11 is uniformly charged by the charging device, not shown in the drawing, at a potential such as approximately 800 V, and exposed to light by an optical head such as a laser, not shown in the drawing, so that the charged potential is reduced to about 100 V in the exposed area. Thus the static latent image is formed.

Besides, in the hopper 19, the developer is stirred and supplied by the stirring and supplying members 16 and 17 to the developer carrying member 12 which is charged by friction. Thus the thin layer of the developer is formed on the circumference of the developer carrying member 12, the thickness of the layer is regulated by the regulation member 15.

The thickness of the developer layer can be made to the thickness of approximately 1.5 times of the thickness of one toner particle by setting the circumference speed of the static latent image carrying member at 100 mm/sec, the circumference speed of the developer carrying member at 200 mm/sec, and the pressure applied to the developer carrying member by the regulation member at a pressure from 10 to 100 N/m.

Then, in the developing zone Da, the developer of toner is flied from the circumference of the developer carrying member in a form of power cloud by the effect of the electric field generated by the developing bias voltage Vb and the alternative voltage applied by the developing bias power source. Thus the toner is supplied to form the toner image.

Figure 2:
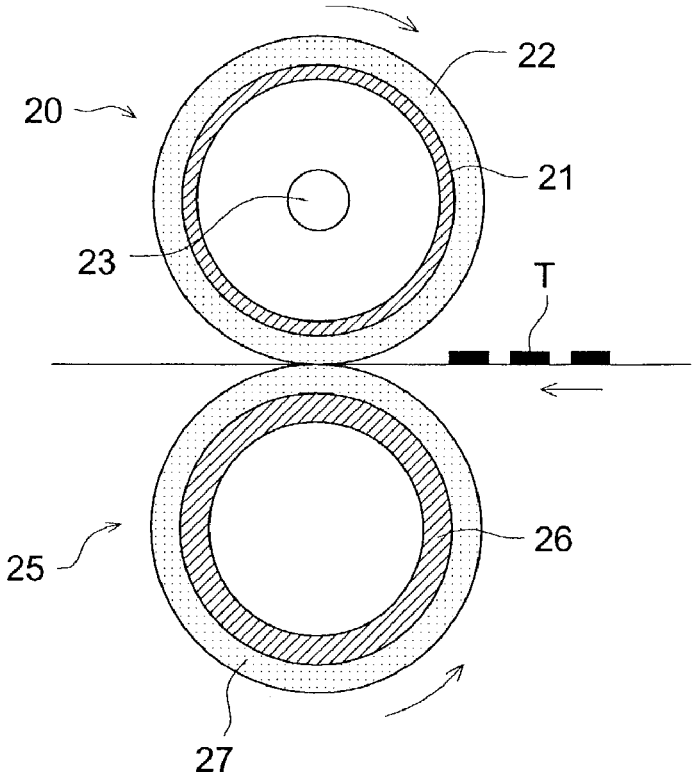
FIG. 2 shows a cross section of an example of the constitution of the developing device used in the invention.

FIG. 2 is a cross-sectional view showing one example of a fixing unit used in an image forming method employing the toner of the present invention. Fixing unit shown in FIG. 2, is comprised of heating roller 20, and pressing roller 25 which comes into contact with said heating roller 20. T is a toner image formed on a transfer paper (being the image forming support).

The heating roller 20 is prepared by forming cover layer 22 comprised of fluorine resins or an elastic body on the surface of metal pipe 21, made of, for example, iron, aluminum, and copper, and alloys thereof, and includes heating member 23 comprised of a linear heater such as a halogen heater in its interior.

Pressure roller 25 comprises cylinder 26 having on its surface covering layer 84 comprised of elastic materials, such as urethane rubber, silicone rubber, and the like, and also foamed rubber.

When the fixing unit shown in FIG. 2 is employed, an example of fixing conditions are as follows: fixing temperature (surface temperature of heating roller 20) is 150 to 210° C., and fixing linear speed is 80 to 640 mm/second.

The cleaning unit may be employed, being provided with a cleaning mechanism. Employed as cleaning systems are a system in which various types of silicone oils are supplied to fixing films, as well as a system in which cleaning is carried out employing a pad, a roller, or a web impregnated with various types of silicone oils.

Examples of silicone oils include polydimethylsiloxane, polyphenylsiloxane, or polydiphenylsiloxane. Further, siloxane containing fluorine may suitably be employed. Those having viscosity of 1 to 100 Pa S at 20° C. are preferable.

EXAMPLES

The present inventing will now be detailed with reference to examples. The term "part(s)" denotes part(s) by weight.

Preparation Example 1 of Resin Particles

Preparation of Latex 1CIO (1) Preparation of Core Particle (The First Stage Polymerization)

Placed into a 5,000 ml separable flask fitted with a stirring unit, a temperature sensor, a cooling pipe, and a nitrogen gas inlet was a surface active agent solution (water based medium) prepared by dissolving 7.08 g of surface active agent (a) mentioned above, which is called an anionic surface active agent (1) hereafter, in 3,010 g of deionized water, and the interior temperature was raised to 80° C. under a nitrogen gas flow while stirring at 230 rpm.

Subsequently, a solution prepared by dissolving 9.2 g of a polymerization initiator (potassium persulfate, KPS) in 200 g of deionized water was added to the surface active agent solution and it was heated at 75° C., a monomer mixture solution consisting of 70.1 g of styrene, 19.9 g of n-butyl acrylate, 10.9 g of methacrylic acid and 7.2 g of n-octyl-3-mercapto propionic acid ester was added dropwise over 1 hour. The mixture underwent polymerization by stirring for 2 hours at 75° C. (a first stage polymerization). Thus latex (a dispersion comprised of higher molecular weight resin particles) was obtained. The resulting latex of core part was designated as Latex (1C).

Peak molecular weight of the resin of Latex 1C was confirmed to be 38,000.

(2) Forming an Inter Layer

A monomer solution was prepared in such way that 144.6 g of Exemplified Compound 19 was added to monomer mixture solution consisting of 105.6 g of styrene, 30.0 g of n-butyl acrylate, 6.2 g of methacrylic acid, 5.6 g of n-octyl-3-mercaptopropionic acid ester and the mixture was heated to 90 ° C. to dissolve the monomers in a flask equipped with a stirrer.

Surfactant solution containing 1.6 g of anionic surfactant (1) dissolved in 2,700 ml of deionized water was heated to 98° C. To this surfactant solution 28 g (converted in solid content) of the latex 1C, dispersion of core particles, was added.

Then the above mentioned surfactant solution containing the Latex 1C was added to the above mentioned monomer solution. They were mixed and dispersed by means of a mechanical dispersion machine, "CLEARMIX" (produced by M Technique Ltd.) equipped with circulating pass for 8 hours, and a dispersion (emulsion) containing dispersion particles (oil droplet) having uniform dispersion particle diameter was prepared.

Subsequently, initiator solution containing 5.1 g of polymerization initiator (KPS) dissolved in 240 ml of deionized water, and 750 ml of deionized water were added to the dispersion (emulsion). Polymerization was conducted by stirring with heating at 98° C. for 12 hours, as the result, latex (dispersion of composite resin particles which are composed of resin particles having lower molecular weight polymer resin covered with a middle molecular weight polymer containing a releasing agent Exemplified Compound 19 was obtained (a second stage polymerization). The resulting latex composed of a core and inter layer was designated as Latex (1CI).

(3) Forming Outer Layer (The Third Stage Polymerization)

Polymerization initiator solution containing 7.4 g of polymerization initiator KPS dissolved in 200 ml deionized water was added to the latex 1CI, then monomer mixture solution consisting of 300 g of styrene, 95 g of n-butylacrylate, 15.3 g of methacrylic acid, and 10.4 g of n-octyl-3-mercaptoprpionic ester was added dropwise over 1 hour at temperature of 85° C. The mixture underwent polymerization by stirring with heating for 2 hours (a third stage polymerization); it was cooled to 28° C. Thus Latex 1CIO composed of core composed of higher molecular weight polymer resin, an inter layer composed of an intermediate molecular weight polymer resin and an outer layer composed of lower molecular weight polymer resin in which inter layer the Exemplified Compound 19 was incorporated was obtained.

The polymers composed of composite resin particles composing the latex 1CIO were confirmed to have weight average particular size of the composite resin particles was 122 nm and peaks at molecular weight of 38,000 (core), 80,000 (inter layer) and 13,000, (outer layer).

Preparation Example 2 of Resin Particles

Latex 2CIO was obtained in the same way as Preparation Example 1 of Resin Particles, except that an amount of the initiator, n-octyl-3-mercapto propionic acid ester, in the first step polymerization was modified to 6.4 g and an amount of the initiator, n-octyl-3-mercapto propionic acid ester, in the second step polymerization was modified to 7.7 g. The latex of composite resin particles composed of a core, an inter layer and an outer layer in each particle, was obtained and designated as Latex (2CIO).

The polymers composed of composite resin particles composing the latex 2CIO were confirmed to have weight average particular size of the composite resin particles was 118 nm and peaks at molecular weight of 46,000 (core), 52,000 (inter layer) and 18,000, (outer layer).

Preparation Example 3 of Resin Particles

Latex 3CIO was obtained in the same way as Preparation Example 1 of Resin Particles, except that an amount of the initiator, n-octyl-3-mercapto propionic acid ester, in the third step polymerization was modified to 8.2 g. The latex of composite resin particles composed of a core, an inter layer and an outer layer in each particle, was obtained and designated as Latex (3CIO).

The polymers composed of composite resin particles composing the latex 2CIO were confirmed to have weight average particular size of the composite resin particles was 118 nm and peaks at molecular weight of 38,000 (core), 78,000 (inter layer) and 22,000, (outer layer).

Preparation Example 4 of Resin Particles

Example of Preparation of Comparative Resin Particles

Preparation of Latex 4CIO (1) Preparation of Core Particle (The First Stage Polymerization)

A dispersion of resin particles Latex 4C was prepared in the same way as Preparation Example 1 of Resin Particles except that a monomer mixture solution consisting of 70.1 g of styrene, 19.9 g of n-butyl acrylate, 10.9 g of methacrylic acid and 7.2 g of n-octyl-3-mercapto propionic acid ester was modified to a monomer mixture solution consisting of 70.1 g of styrene, 19.9 g of n-butyl acrylate and 10.9 g of methacrylic acid in the first step polymerization.

(2) Forming an Inter Layer

Latex 4CI was prepared in the same way as Preparation Example 1 of Resin Particles except that an amount of Exemplified Compound 19 was modified to 98.0 g and Latex 4C was employed in place of Latex 1C. Thus resin particles having core and an interlayer containing a releasing agent Exemplified Compound 19 was obtained. The resulting latex was designated as Latex 4CI.

(3) Forming Outer Layer (The Third Stage Polymerization)

Latex 4CIO was prepared in the same way as Preparation Example 1 of Resin Particles except that Latex 1CI was replaced by Latex 4CI in the third step polymerization. Thus Latex 4CIO composed of core composed of higher molecular weight polymer resin, an inter layer composed of an intermediate molecular weight polymer resin and an outer layer composed of lower molecular weight polymer resin in which inter layer the Exemplified Compound 19 was incorporated was obtained.

The polymers composed of composite resin particles composing the latex 4CIO were confirmed to have weight average particular size of the composite resin particles was 109 nm and peaks at molecular weight of 32,000 (core), 71,000 (inter layer) and 18,000, (outer layer).

Preparation Example 5 of Resin Particles

Example of Preparation of Comparative Resin Particles

Latex 5CIO was obtained in the same way as Preparation Example 4 of Resin Particles, except that an amount of the initiator, n-octyl-3-mercapto propionic acid ester, in the second step polymerization was modified to 4.1 g. The latex of composite resin particles composed of a core, an inter layer and an outer layer in each particle, was obtained and designated as Latex (5CIO).

The polymers composed of composite resin particles composing the latex 5CIO were confirmed to have weight average particular size of the composite resin particles was 142 nm and peaks at molecular weight of 36,000 (core), 75,000 (inter layer) and 18,000 (outer layer).

Preparation Example 6 of Resin Particles

Example of Preparation of Comparative Resin Particles

Latex 6CIO was obtained in the same way as Preparation Example 4 of Resin Particles, except that an amount of the initiator, n-octyl-3-mercapto propionic acid ester, in the third step polymerization was modified to 12.2 g. The latex of composite resin particles composed of a core, an inter layer and an outer layer in each particle, was obtained and designated as Latex 6CIO.

The polymers composed of composite resin particles composing the latex 6CIO were confirmed to have weight average particular size of the composite resin particles was 106 nm and peaks at molecular weight of 32,000 (core), 77,000 (inter layer) and 18,000 (outer layer).

Preparation Example 1 of Colorant Particle Dispersion

Added to 1600 ml of deionized water were 59.0 g of sodium n-dodecyl sulfate which were stirred and dissolved. While stirring the resulting solution, 420 g of pigment, (C.I. Pigment Red 57, manufactured by Nippon Pigment Co., Ltd.), were gradually added, and subsequently dispersed employing a stirring unit, CLEARMIX (produced by M Technique Ltd.). Thus a colorant particle dispersion (hereinafter referred to as "Colorant Dispersion (1)") was prepared. The colorant particle diameter of said Colorant Dispersion (1) was determined employing an electrophoresis light scattering photometer "ELS-800" (produced by Otsuka Electronics Co., Ltd.), resulting in a weight average particle diameter measurement of 68 nm.

Preparation of Colored Particles 1

In a four mouth flask as the reaction vessel to which a thermal sensor, cooler, nitrogen conduction apparatus and stirrer were attached, 420.7 g in terms of solid component of each of the foregoing Latex 1CIO, 900 g of ion-exchanged water 166 g of Colorant Particle Dispersion 1, which was kept standing for 48 hours after preparation, were charged and heated to 30° C. To this dispersion 5 mol/L of sodium hydroxide solution was added to adjust pH of 10.5. Aqueous solution, in which 12.1 g of magnesium chloride hepta hydrate was dissolved in 1,000 ml of ion-exchanged water, was added with agitation over 10 min at 30° C. It was kept for 3 minutes and then heated to 90° C. over 60 minutes.

While maintaining the resulting state, the diameter of associated particles was measured employing Coulter MULTISIZER. When the volume average particle diameter reached to 5 μm, the growth of particles was terminated by the addition of an aqueous solution prepared by dissolving 40.2 g of sodium chloride in 1,000 ml of deionized water. Further stirring was continually carried out at a liquid media temperature of 95° C. for 26 hours, while shape and diameter of particles were monitored. Stirring was continued while circularity of associated particle was measured with adding SDS aqueous solution so that the growth of particle diameter stopped when the diameter exceeded 5.2 μm, and the stirring was terminated when the circularity coefficient reached at 0.972. Thus the Colored Particles 1 was obtained.

Preparation of Colored Particles 2

Colored Particles 2 were obtained in the same way as preparation of colored particles 1, except that Colorant Particle Dispersion 1 was kept standing for 72 hours after preparation, and the stirring was continued so as to circularity coefficient reached to 0.961.

Preparation of Colored Particles 3

Colored Particles 3 were obtained in the same way as preparation of colored particles 1, except that Colorant Particle Dispersion 1 was kept standing for 96 hours after preparation, and the stirring was continued so as to circularity coefficient reached to 0.942.

Preparation of Colored Particles 4

Colored Particles 4 were obtained in the same way as preparation of colored particles 1, except that Latex 2CIO was employed in place of Latex 1CIO, Particle Dispersion 1 was employed after having kept standing for 8 hours after preparation, and the stirring was continued so as to circularity coefficient reached to 0.978.

Preparation of Colored Particles 5

Colored Particles 5 were obtained in the same way as preparation of colored particles 1, except that Colorant Particle Dispersion 1 was kept standing for 120 hours after preparation, and the stirring was continued so as to circularity coefficient reached to 0.932.

Preparation of Colored Particles 6

Colored Particles 4 were obtained in the same way as preparation of colored particles 1, except that Latex 3CIO was employed in place of Latex 1CIO, Particle Dispersion 1 was kept standing for 6 hours after preparation, and the stirring was continued so as to circularity coefficient reached to 0.987.

Preparation of Comparative Colored Particles 1

Comparative Colored Particles 1 were obtained in the same way as preparation of colored particles 1, except that Latex 4CIO was employed in place of Latex 1CIO, pH was adjusted to 9.2 by employing 5 mol/L of sodium hydroxide solution, and the stirring was continued so as to circularity coefficient reached to 0.951.

Preparation of Comparative Colored Particles 2

Placed into a four-necked flask fitted with a high speed stirring unit (TK Homomixer) were 710 g of deionized water and 450 g of 0.1 mole/liter aqueous trisodium phosphate. To the resulting mixture 68 g of 1.0 mole/liter aqueous calcium chloride solution were gradually added at a stirring condition of 12,000 rpm, whereby a water based medium comprised of a dispersion containing colloidal trisodium phosphate was prepared.

Figure 3:
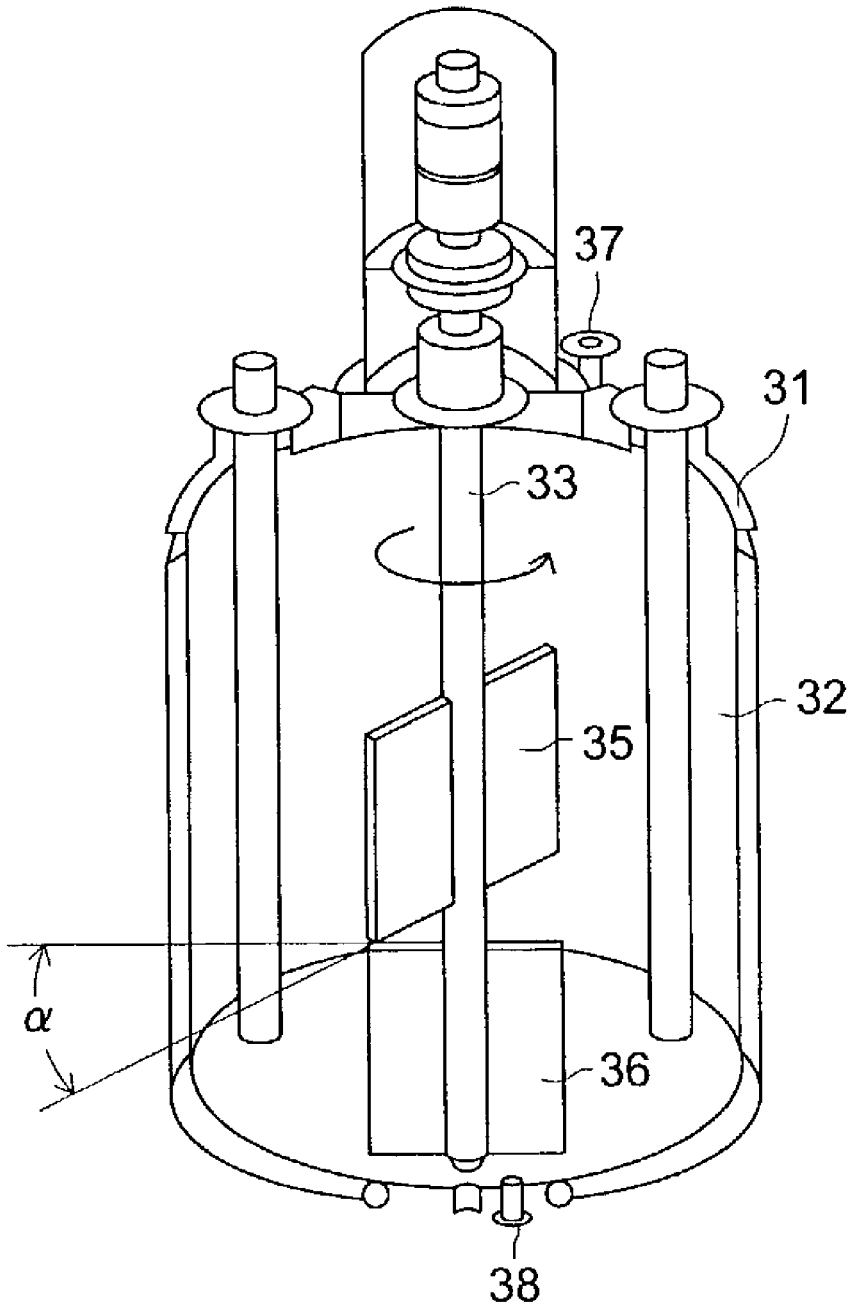
FIG. 3 shows a reaction apparatus used in the example.

Placed into a four-necked flask fitted with a high speed stirring unit (TK Homomixer) 10 g of carbon black Regal 330R* (produced by Cabot Corp.) with a monomer mixture solution consisting of 165 g of styrene and 35 g of n-butyl acrylate, 2 g of di-butylsalicylic acid metal compound, 8 g of styrene-methacrylic acid copolymer, 20 g of paraffin wax having a melting point of 70° C. They were heated 60° C., and stirred at 12,000 rpm to obtain dispersion. Subsequently, 10 parts of 2,2.azobis(2,4-dimethylvaleronitrile) as the polymerization initiator was added to the resulting dispersion, whereby a monomer composition was prepared. Said monomer composition prepared as above was added to and dispersed in the water based medium at a stirring condition of 10,000 rpm for 20 minutes. Subsequently, the resulting dispersing underwent polymerization at 95° C. for 15 hours at a stirring condition of 1000 rpm, employing reaction vessel as shown in FIG. 3, wherein crossing angle was set to 45°. When the polymerization reaction completed, hydrochloric acid was added and tricalcium phosphate, which was a dispersion stabilizer, was removed. The resulting liquid was classified by employing a centrifuge. Subsequently, the liquid was subjected to filtration, washing, and drying to obtain Comparative Colored Particles 2.

The obtained Comparative Colored Particles 2 was dispersed in a surfactant aqueous solution and 0.3 μl was taken to measure the circularity coefficient by employing FPIA-2000. The measurement was conducted in such condition that the number of determined particles were from 3,000 to 5,000, particle density was from 10,000 to 20,000 per μl, and measuring range of a circle converted diameter of 0.6 to 400. The result is summarized in Table 1.

FIG. 3 is an example of a stirring vessel equipped with stirring blades. Vertical rotation shaft 33 is provided in the central portion in a longitudinal type cylindrical stirring vessel 32 equipped with jacket 31 for heat exchange on the circumferential portion of said stirring vessel, with integral lower level stirring blades 36 provided on said rotation shaft 33 near the bottom surface of the stirring vessel, and stirring blades 35 provided at the upper level. It is characterized that obstacles such as baffle plates and the like, which generate a turbulent flow, are not provided. Stirring blades 35 at the upper level is provided so as to have an advanced crossed axes angle $\alpha$ in the rotational direction with respect to the stirring blades 34 positioned at the lower level.

Preparation of Comparative Colored Particles 3

Comparative Colored Particles 3 were obtained in the same way as preparation of Comparative Colored Particles 1, except that Latex 5CIO was employed in place of Latex 4CIO, and the stirring was continued so as to circularity coefficient reached to 0.965.

Preparation of Comparative Colored Particles 4

Comparative Colored Particles 4 were obtained in the same way as preparation of Comparative Colored Particles 1, except that Latex 6CIO was employed in place of Latex 4CIO, and the stirring was continued so as to circularity coefficient reached to 0.967. The result is summarized in Table 1.

Preparation of Comparative Colored Particles 5

Comparative Colored Particles 5 were obtained in the same way as preparation of Colored Particles 2, except that the stirring was continued so as to circularity coefficient reached to 0.915.

Preparation of Comparative Colored Particles 6

Comparative Colored Particles 6 were obtained in the same way as preparation of Colored Particles 2, except that the stirring was continued so as to circularity coefficient reached to 0.994.

Preparation of Developers 1 through 6 and Comparative Developers 1, 3 and 4

To each of 100 parts of Colored Particles 1 through 6 and Comparative Colored Particles 1, 3 and 4, 0.8 weight parts of silica, which has treated with hexadimethyldisilazane, an average particle diameter of 12 nm, hydrophobicity of 60% and BET specific surface of 150 $m^2/g$, was added and mixed for 10 minutes by Henschel mixer with circumferential speed of stirring blade at 25 m/sec. Then 1.5 parts of strontium titanate, which has an average particle diameter of 250 nm, was added and stirred mixed for 10 minutes by Henschel mixer to obtain Toner Particles 1 through 6 and Comparative Toner Particles 1, 3 and 4 were obtained.

Preparation of Comparative Developers 2, 5 and 6

To each of 100 parts of Comparative Colored Particles 2, 5 and 6, 1.0 weight parts of silica fine particles were added and stirred mixed for 10 minutes by Henschel mixer to obtain Comparative Toner Particles 2, 5 and 6 were obtained.

Preparation of Comparative Developer 9

In a four mouth flask as the reaction vessel to which a thermal sensor, cooler, nitrogen conduction apparatus and stirrer were attached, 2.5 mol parts of terephthalic acid, 2.5 mol parts of isophthalic acid, and 4.8 mol parts of polyoxyethylene-(2.0)-2,2-bis(4-hydroxyphenyl)propane were charged, and further 0.07 parts of catalyser dibutyl tin oxide based on total acid component was added under a nitrogen gas flow. Reaction was conducted at 220° C. for 15 hours while water formed by dehydrating condensation was removed to obtain linear crystalline aromatic polyester resin having weight average molecular weight Mw of 11,000 and number average molecular weight Mn of 4,100.

A mixture was obtained by blending 95 parts of the obtained linear crystalline aromatic polyester resin, 4 parts of colorant C.I. Pigment Red 122, manufactured by Nippon Pigment Co., Ltd., and 1 part of a charge controlling agent LR-147, manufactured by Japan Carlit Co., Ltd., by employing Henschel mixer. The mixed compounds subjected to melt-kneading by a biaxial extrusion kneading machine, the resulted compounds were cooled to room temperature, were crushed by a hammer mill, then were pulverized to fine particles by employing a jet mill, and the fine particles were classified by air classifying machine to obtain fine pulverized particles having D50% diameter of 8.5 μm.

One part of silica RX-50, manufactured by Nippon Aerosil Co., Ltd., was added to 100 parts of the obtained pulverized particles to obtain Comparative Particles 7.

Circularity coefficient of the obtained Comparative Toner Particles 7 was measured by a method described in the preparation of Comparative Colored Particles 2, above. The result is summarized in Table 1.

Particle hardness, specific softening point and average Voronoi's polygon area were measured in each toner particles. The result is summarized in Table 1. The circularity coefficient was not changed by addition of silica.

Particle Hardness

The 10% deformation compressing load of the toner particle was measured by micro hardness meter HMV-1/2/1T/2T using a planar compression device with a bottom surface diameter of 50 μm at a temperature of 20° C., a relative humidity of 55% and a loading rate of 0.89 mN/sec. Measurement was performed for 50 toner particles and the arithmetic average of thus obtained results was calculated.

Softening Point

This measurement is carried out by using a flow tester with a die diameter of 1 mm under a temperature of 20° C. and a relative humidity of 50%. A previously prepared pellet of the binder resin, with a diameter of 10 mm and a length of 12 mm, is heated to 80° C. for 300 seconds. The specific softening point is measured from the relationship of the temperature and the flow amount measured at a load of 200 N at a temperature rising rate of 6 C. per minute. The softening temperature is determined by the temperature at which the flow amount becomes 5 mm by the off-set method.

Average of Voronoi's Polygon

The average value of the Voronoi's polygon is determined according to an electronmicroscopic photograph of the cross section of the toner particle using an image analysis apparatus attached to the electronmicroscope. The average value of the area of plural polygons formed by lines each perpendicularly crossing at the middle point of the line connecting the gravity centers of the adjacent islands is determined for each of 1,000 toner particles, and the arithmetic average of thus obtained results is calculated.

TABLE 1

| | Particle hardness (mN) | Softening point (° C.) | Circularity Coefficient | Average area of Voronoi's polygons ($nm^2$) |
|---|---|---|---|---|
| Toner particle 1 | 18.6 | 116.4 | 0.972 | 62,400 |
| Toner particle 2 | 13.4 | 112.1 | 0.961 | 43,800 |
| Toner particle 3 | 8.7 | 108.5 | 0.942 | 78,600 |
| Toner particle 4 | 21.7 | 123.4 | 0.978 | 5,600 |
| Toner particle 5 | 6.2 | 106.1 | 0.932 | 104,200 |
| Toner particle 6 | 23.4 | 131.2 | 0.987 | 4,800 |
| Comparative toner particle 1 | 5.4 | 121.2 | 0.951 | 114,300 |
| Comparative toner particle 2 | 25.1 | 115.4 | 0.911 | 142,000 |
| Comparative toner particle 3 | 23.4 | 134.3 | 0.965 | 71,000 |
| Comparative toner particle 4 | 5.1 | 103.2 | 0.967 | 61,800 |
| Comparative toner particle 5 | 4.9 | 115.2 | 0.915 | 44,200 |
| Comparative toner particle 6 | 24.9 | 116.2 | 0.994 | 42,800 |
| Comparative toner particle 7 | 4.3 | 120.4 | 0.908 | 7,400 |

Examples 1 Through 6 and Comparative Examples 1 Through 7

Single-component Developers 1 through 6 and Comparative Developers 1 through 7 were each prepared using the thus obtained toner particles, respectively. For evaluating the properties of toner particles, each of the example developers and the comparative example developers was subjected to a practical image forming test under the following conditions using a digital copying machine at a temperature of 22° C. and a relative humidity of 45%. The copying machine had a system for recycling the toner using a cleaning device, a developing device shown in FIG. 1 and a fixing device shown in FIG. 2. The results of the test are shown in Table 2.

Image Forming Condition

Cleaning Method of the Static Latent Image Carrying Member: Blade Method

Charging condition: The initial charging potential was adjusted to 750 V using a brush type contact charging roller.

Exposure condition: The exposure amount was controlled so that the potential at the exposed area was 50 V.

Developing condition: DC bias was adjusted to 550 V, and a roller transfer method was used.

The fixing temperature was controlled so the surface temperature of the heating roller was 165° C. and the line speed of writing was set at 120 mm per second.

Fixing Suitability Test

The fixing performance of the toner was evaluated according to the results of the following tests 1 through 3.

1. An image having an image ratio of 15% was continuously formed on 500 sheets of thick paper, at a weight of 200 g/m$^2$, and 500 sheets of thin paper, at a weight of 45 g/m$^2$ as the image receiving material in said order, and contamination occurring on non-image areas of the image receiving material was visually evaluated.

2. An image having a toner amount of 65 mg/M$^2$ was continuously formed on 500,000 sheets of thick 200 g/m$^2$ paper, and the optical density of the image formed on the 100,000th sheet was measured. Then the image was rubbed 20 times with a cotton cloth at a pressure of 200 kPa, and the image density after the rubbing was measured. The fixing ratio was determined by the following formula.

Fixing ratio (%)=(Image density after rubbing)/(Image density before rubbing)×100

3. An image having a toner amount of 0.7±0.05 mg/cm$^2$ was continuously formed on 500,000 OHP sheets, as the image receiving material. The spectral transmittance in the image area of the 20$^{th}$ sheet was measured by a spectrophotometer manufactured by Hitachi Ltd., based on the spectral transmittance at the non image area, and the difference between the transmittance at 650 nm and that at 550 nm was calculated as the indicator of the transparency of the OHP image.

In Tables 2 and 3, the evaluation results are represented by the following letters:

A: The fixing ratio after rubbing was at least 90% and the OHP transparency was at least 90%.

B: The fixing ratio after rubbing was at least 80% but less than 90% or no contamination occurred and the OHP transparency was at least 75% but less than 90%.

C: Contamination occurred and the fixing ratio after rubbing was less than 80%, and the OHP transparency was less than 75%.

Transferring Performance Test

An image with an image ratio of 12% constituted by small text characters was continuously formed on 10,000 sheets of thick neutral 200 g/m$^2$ paper. Then the weight of the toner consumed in the developing device while the image was formed, hereinafter referred to as the consumed toner amount, and the weight of toner recovered by the cleaning device, hereinafter referred to as the recovered toner amount, were measured. The transferring ratio was calculated using the following formula.

Transferring ratio (%)={(Consumed toner amount)−(Recovered toner amount)}/(Consumed toner amount)

In Tables 2 and 3, the evaluation results are represented by the following letters:

A: The transferring ratio of the image at the first few sheets (at the initial period) and that at the 10,000th image were at least 98%.

B: The transferring ratio of the image at the initial period was not less than 89% and that at the 10,000th image were at least 92% but less than 98%.

C: The transferring ratio of the image at the initial period was at least 89% and that at the 10,000th image were at least 92%.

Test of Anti-Contamination Performance, Damage Occurring on the Static Latent Image Carrying Member and Occurrence of Burial of Additive An image having an image ratio of 7% was continuously formed on 500,000 sheets of common 80 g/m$^2$. Occurrence of adhesion of molten toner on the developer carrying member of the developing device and occurrence of damage on the static latent image carrying member were visually observed for evaluating the anti-contamination performance and the tendency of damage to the static latent image carrying member. Further, the toner from the developing device after the image formation was sampled and the surface of toner particles was observed using an electron-microscope to confirm burial of external additive in the toner particles.

In Tables 2 and 3, the evaluation results are represented by the following letters:

In the test of the anti-contamination performance:

A: No molten toner was adhered.

B: Adhered toner was slightly observed but the toner was acceptable for practical use since no adverse influence was observed on the image.

C: Molten toner was adhered and unevenness of the image caused by adhesion of the toner occurred.

In the test of damage occurrence on the static latent image carrying member:

A: No damage occurred.

B: Damage occurred but the toner was acceptable for practical use since no adverse influence was-observed on the image.

C: Damage occurred and white spots appeared over the entire surface of the image formed area.

In the test of the burial of external additive:

A: Burial did not occurred.

B: The toner particles had almost of the initial appearance and there were no problems for the practical use.

C: Burial occurred and the surface of the toner particle was smooth.

Test of Charge Stability

Stability of the charge of the toner was evaluated by the following procedure. An image having an image ratio of 7% was continuously formed on 500,000 sheets of common 80 g/m$^2$ paper. During the course of image formation, charging amount of the toner on the developer carrying member of the developing device was measured every 100,000th sheet by a suction type charging amount measuring apparatus.

In Tables 2 and 3, the evaluation results are represented by the following characters:

A: Fluctuation of charging amount for all measured results was within the range of ±10% of charging amount at the initiation of image formation.

B: Fluctuation of charging amount for all measured results was more than ±10% but less than ±15% of charging amount at the initiation of image formation.

C: Fluctuation of charging amount for all measured results was more than ±15% of charging amount at the initiation of image formation.

Test of Image Density Fluctuation

Image density fluctuation of the image was evaluated by the following procedure. An image having an image ratio of 7% was continuously formed on 500,000 sheets of common 80 g/m$^2$ paper. During the course of image formation, the maximum density of the image was measured every 100,000 sheets using a Macbeth reflective densitometer.

In Tables 2 and 3, the evaluation results are represented by the following characters:

A: Fluctuation of the maximum density for all measured results was within the range of ±3% of the maximum density at the initiation image formation.

B: Fluctuation of the maximum density for all measured results was more than ±3% but less than ±5% of the maximum density at the initiation image formation.

C: Fluctuation of the maximum density for all measured results was more than ±5% of the maximum density at the initiation image formation.

TABLE 2

| | Example 1 | Example 2 | Example 3 | Example 4 | Example 5 | Example 6 |
|---|---|---|---|---|---|---|
| Fixing performance | A | A | A | B | A | B |
| Transferring performance | A | A | B | B | B | B |
| Anti-contamination performance | A | A | B | A | B | A |
| Damage occurrence | A | A | A | A | A | B |
| Burying occurrence | A | A | A | A | B | A |
| Charging stability | A | A | A | A | B | B |
| Image density fluctuation | A | A | A | A | B | B |

TABLE 3

| | Comp. 1 | Comp. 2 | Comp. 3 | Comp. 4 | Comp. 5 | Comp. 6 | Comp. 7 |
|---|---|---|---|---|---|---|---|
| Fixing performance | B | C | C | B | B | C | B |
| Transferring performance | C | C | C | C | C | C | C |
| Anti-contamination performance | B | B | B | C | B | B | C |
| Damage occurrence | B | C | B | B | B | C | B |
| Burying occurrence | C | B | B | C | C | B | C |
| Charging stability | C | C | B | B | C | C | C |
| Image density fluctuation | C | C | C | C | C | C | C |

Comp.: Comparative example

It can be confirmed from the above results that the toners of Examples 1 through 6 show excellent transferring performance and developing performance along with excellent fixing performance and anti-contamination performance.

It is also confirmed that the high quality image can be stably obtained by the use of the single-component toners of Examples 1 through 6.

Toner according to the invention comprises toner particles which are each composed of binder resin having a specified specific softening point and has the specified circularity and particle hardness. Consequently, the toner displays high fixing performance since it is satisfactorily molten in the heat-fixing process. Further, in processes other than the fixing process, particular in the process for providing the required amount of charge, adhesion of the molten toner onto the constitution members of the image forming apparatus, being contamination can be minimized. Thus excellent fixing performance and anti-contamination performance can be attained.

When the toner contains an external additive, the releasing of inorganic particles of the external additive from the toner particle can be inhibited, and the burial of the external additive into the toner particle is also inhibited since the toner particle exhibits the specified hardness. Consequently, no damage caused by released external additive occurs on the constituting members of the image forming apparatus and the stable charging can be attained. Therefore, excellent transferring performance and developing performance together with excellent fixing performance and anti-contamination performance can be attained.

High quality images can be stably attained by the image forming method of the invention since the toner produced by the foregoing producing method is used.

The invention claimed is:

1. A toner comprising a toner particle containing a binder resin and a colorant; wherein the binder resin has a peak or a shoulder within the range of from 40,000 to 500,000 and a peak or a shoulder within the range from 11,000 to 22,000 in the - molecular weight distribution measured by gel permeation chromatography (GPC) employing tetrahydrofuran (THF), and wherein the toner has a softening point of from 105 to 132° C., and the toner particle has a hardness of from 6.0 to 24.0 mN and a circularity of from 0.92 to 0.99.

2. The toner of claim 1, wherein the toner particle has a hardness of from 8.0 to 22.0 mN.

3. The toner of claim 2, wherein the toner particle has a hardness of from 13.0 to 20.0 mN.

4. The toner of claim 1, wherein the toner has a softening point of from 108 to 124° C.

5. The toner of claim 1, wherein the toner particle has a matrix-domain structure in which the matrix is constituted by a continuous phase of the binder resin and the domain is constituted by isolated phase of the colorant.

6. The toner of claim 5, wherein an average area of Voronoi's polygon indicating respective domain phase is from 20,000 to 120,000 $nm^2$.

7. The toner of claim 6, having the circularity of 0.94 to 0.98, and the softening point of 112 to 120° C., and the average area of Voronoi's polygon of from 40,000 to 100,000 $nm^2$.

8. The toner of claim 1, wherein a variation coefficient of circularity of the toner particle is from 2.1 to 4.7%.

9. The toner of claim 1, wherein the binder resin comprises composite resin particles containing a core, an inner layer and an outer layer.

10. The toner of claim 1, wherein the toner contains an external additive composed of inorganic particles having an average primary particle diameter of from 30 to 500 nm.

11. The toner of claim 1, wherein the binder resin is derived from at least one monomer selected from an aromatic vinyl monomer, acrylic acid ester based monomer, methacrylic acid ester based monomer, vinyl ester based monomer, vinyl ether based monomer, monoolefin based monomer, diolefin based monomers, and halogenated olefin monomer.

12. The toner of claim 1, wherein the binder resin is derived from at least one first monomer selected from styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrene, 3,4-dichlorostyrene, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, diethyl aminoethyl methacrylate, vinyl acetate, vinyl propionate, vinyl benzoate, vinyl methyl ether, vinyl ethyl ether, vinyl isobutyl ether, vinyl phenyl ether, ethylene, propylene, isobutylene, 1-butene, 1-pentene, 4-methyl-1-pentene, butadiene, isoprene, chloroprene, vinyl chloride, vinylidene chloride, and vinyl bromide.

13. The toner of claim 12, wherein the binder resin is derived from the first monomer and at least one of second monomers selected from acrylic acid, methacrylic acid, fumaric acid, maleic acid, itaconic acid, cinnamic acid, maleic monobutylate, maleic monooctylate, styrenesulfonic acid, allylsulfosuccinic acid, octyl allylsulfosuccinate, dimethylaminoethylacrylate, dimethylaminoethylmethacrylate, diethylaminoethylacrylate, diethylaminoethylmethacrylate, 3-dimethylaminophenylacrylate, 2-hydroxy-3-methacryloxy propyl trimethylammonium salt, acrylamide, N-butylacrylamide, N,N-dibutyl acrylamide, piperidyl acrylamide, methacrylamide, N-butylmethacrylamide, N-octadecyl acrylamide, vinyl N-methylpyridinium chloride, vinyl N-ethyl pyridinium chloride, N,N-diallyl methylammonium chloride, N,N-diallyl ethylammonium chloride, and alkali metal salts or alkali earth metal salts of styrenesulfonic acid, allylsulfosuccinic acid and octyl allylsulfosuccinate.

14. The toner of claim 1, wherein the toner has the circularity of from 0.96 to 0.98, and the softening point of from 112 to 120° C.

15. The toner of claim 1, wherein the binder resin has ratio of weight average molecular weight to number average molecular weight (Mw/Mn) of from 1.1 to 4.6.

16. A toner comprising a toner particle containing a colorant and a binder resin derived from at least one monomer selected from an aromatic vinyl monomer, acrylic acid ester based monomer, methacrylic acid ester based monomer, vinyl ester based monomer, vinyl ether based monomer, monoolefin based monomer, diolefin based monomers, and halogenated olefin monomer, wherein the toner has a softening point of from 105 to 132° C., and the toner particle has a hardness of from 6.0 to 24.0 mN, a circularity of from 0.92 to 0.99, and a matrix-domain structure in which the matrix is constituted by a continuous phase of the binder resin and the domain is constituted by isolated phase of the colorant, wherein an average area of Voronoi's polygon indicating respective domain phase is from 20,000 to 120,000 $nm^2$.

17. The method of claim 18, wherein the toner particle has a matrix-domain structure in which the matrix is constituted by a continuous phase of the binder resin and the domain is constituted by isolated phase of the colorant and wherein an average area of Voronoi's polygon indicating respective domain phase is from 20,000 to 120,000 $nm^2$.

18. An image forming method comprising:

forming a static latent image on a static latent image carrying member, developing the static latent image by a developer to form a toner image, transferring the toner image to an image receiving material, and fixing the toner image by heat, wherein the developer comprises a toner of claim 1.

* * * * *